US006510723B2

(12) United States Patent
Amherd

(10) Patent No.: US 6,510,723 B2
(45) Date of Patent: Jan. 28, 2003

(54) PRESSING TOOL FOR PRESSING COUPLING ELEMENTS

(75) Inventor: Renè Amherd, Reutlingen (CH)

(73) Assignee: Von Arx AG, Sissach (CH)

( * ) Notice: Subject to any disclaimer, the term of this patent is extended or adjusted under 35 U.S.C. 154(b) by 47 days.

(21) Appl. No.: 09/866,496

(22) Filed: May 25, 2001

(65) Prior Publication Data

US 2002/0007658 A1 Jan. 24, 2002

(30) Foreign Application Priority Data

May 25, 2000 (CH) ..... 1052/00

(51) Int. Cl.[7] ..... B21J 15/20
(52) U.S. Cl. ..... 72/453.16; 60/477
(58) Field of Search ..... 72/453.15, 453.16, 72/453.17; 60/477, 478; 418/205, 206.1, 206.7

(56) References Cited

U.S. PATENT DOCUMENTS 3,139,834 A * 7/1964 Blomgren ..... 418/206.1
5,040,400 A 8/1991 Nastasi
5,125,324 A 6/1992 Araki et al.
5,611,228 A 3/1997 Dummermuth
5,875,629 A * 3/1999 Kimura ..... 60/477
6,152,715 A * 11/2000 Kaempe et al. ..... 418/206.1

FOREIGN PATENT DOCUMENTS

| | | |
|---|---|---|
| DE | 197 43 747 | 1/1999 |
| EP | 389 716 | 10/1990 |
| EP | 0 712 696 | 5/1996 |
| EP | 908 657 | 4/1999 |

* cited by examiner

*Primary Examiner*—Lowell A. Larson
(74) *Attorney, Agent, or Firm*—Pauley Petersen Kinne & Erickson

(57) ABSTRACT

A pressing tool having an electric motor fed by a battery. The electric motor drives a gear pump with two rotor shafts which are accommodated in a hydraulic block. The rotor shafts are mounted in a gear housing on one side of the hydraulic block and in a cylinder housing of a piston cylinder unit which bears on an other side of the hydraulic block. This gear pump uses an extremely simple construction manner and simultaneously achieves a high delivery volume. The high delivery volume leads to an extremely low loading of the battery, by which its operational duration is increased.

9 Claims, 3 Drawing Sheets

PRESSING TOOL FOR PRESSING COUPLING ELEMENTS

BACKGROUND OF THE INVENTION

1. Field of the Invention

This invention relates to a portable, hydraulically functioning pressing tool for the pressing of coupling elements, with a fork-like receiver and with a clamping pincer which is held in the receiver and which is actuatable by a piston cylinder unit with an integrated restoring spring.

2. Description of Related Art

Portable, hydraulically functioning pressing tools are known and used for pressing coupling elements, such as press sleeves, press fittings, connecting sleeves, tube sections inserted into one another and likewise. The pressing tools have a clamping pincer with clamping jaws which form a pressing space for receiving the coupling elements to be pressed. The pressing force required for the pressing is delivered by a generally hydraulic drive.

Because the apparatus of interest here is preferably used on building sites it is an electrically driven apparatus. By way of example, U.S. Pat. No. 5,040,400 shows a pneumatically functioning apparatus. An electrically driven pressing tool apparatus is taught by European Patent Reference EP-A-0'712'696 (Pamag A G). A conventional apparatus is supplied via electricity mains. However the availability of electrical connection sources on building sites is often very limited. For this reason it is desirable to be able to operate independently of the mains electricity, for example by using a battery. However, as is known, a battery-operated apparatus is very heavily dependent on operating in a manner which is economical with regard to energy, so that a reasonable operational duration per battery charging may be achieved.

With available hydraulically functioning pressing tools, independently ofthe type of the electrical supply, rotation pumps or piston pumps have been applied. All previously known systems have a relatively low delivery power and accordingly the operational duration per stroke of the piston cylinder unit to be actuated is relatively long. Although this is insignificant with an apparatus which depends on mains electricity, with a battery-operated apparatus this operation time is of underlying importance.

U.S. Pat. No. 5,125,324 teaches a mains operated apparatus of the previously mentioned type. The hydraulic pump, which is a piston pump, acts on a piston cylinder unit with an integrated restoring spring, wherein the pump is completely arranged in a hydraulic block between a drive-side gear and a piston cylinder unit.

SUMMARY OF THE INVENTION

It is one object of this invention to provide a portable, hydraulically functioning pressing tool having an operational duration per pressing procedure as short as possible, so that the operational duration per charging of the battery with the battery-operated apparatus is sufficient for as many pressing procedures as possible. It is another object of this invention to provide a compact pressing tool which is correspondingly light and which is inexpensive to manufacture.

A portable hydraulically operated pressing tool with the features described in this specification and in the following claims achieves these objects. The apparatus of this invention can use a gear pump. Because a gear pump with a sufficient power requires a relatively large space, the arrangement in the apparatus is of significant importance in order to achieve the mentioned solution without considerably enlarging the apparatus, to avoid additional weight which may be unwieldy. This invention achieves the objects with a modular construction wherein a gear pump is arranged in the hydraulic block and bears in both neighboring modules on both sides of the hydraulic block. This results also in an extremely compact arrangement with correspondingly short hydraulic conduits and accordingly leads to a relatively light pressing tool, even with the incorporated battery.

BRIEF DESCRIPTION OF THE DRAWINGS

Further advantageous embodiments of the hydraulically operated pressing tool according to this invention are deduced from the specification and claims and their significance is explained in the subsequent description with reference to the drawings, wherein:

DESCRIPTION OF PREFERRED EMBODIMENTS

Figure 1:
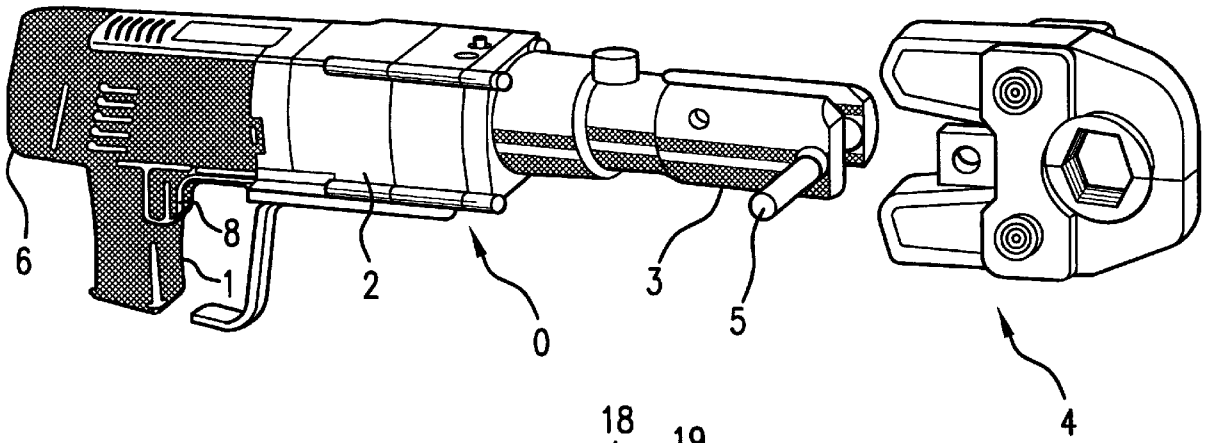
FIG. 1 is a perspective view of a pressing tool according to this invention.

A pressing tool 0 is an electrohydraulic apparatus which can be a battery-operated apparatus. The pressing tool 0 has a pressing tool function unit 2 on which there is formed a grip 1. In the rearward extension on the function unit 2, a battery housing 6 is formed as a removable part. In the forward extension of the pressing tool function unit 2 there is recognizable a fork-like receiver 3. In the fork-like receiver 3 is held a clamping pincer 4 in a secured manner in the receiver 3, with a security bolt 5. For the actuation of the apparatus there is a release switch 8.

Figure 3:
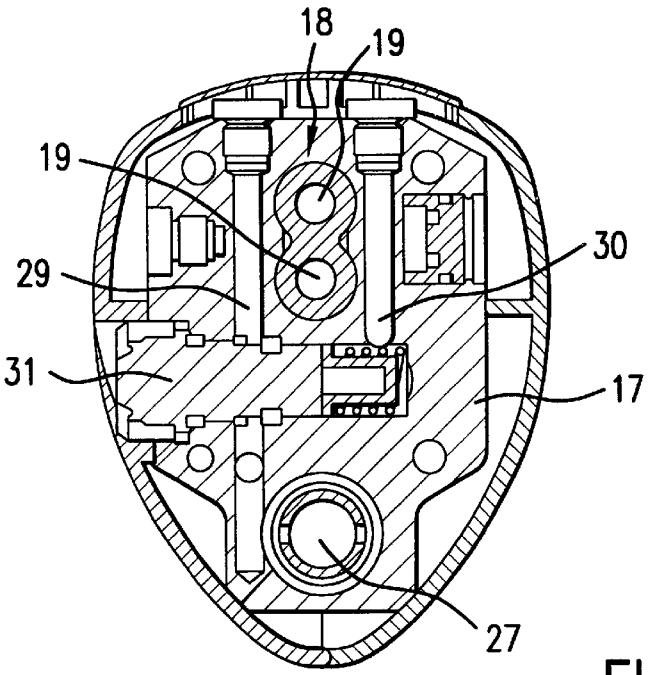
FIG. 3 is a vertical cross section shown in a simplified representation.
Figure 2:
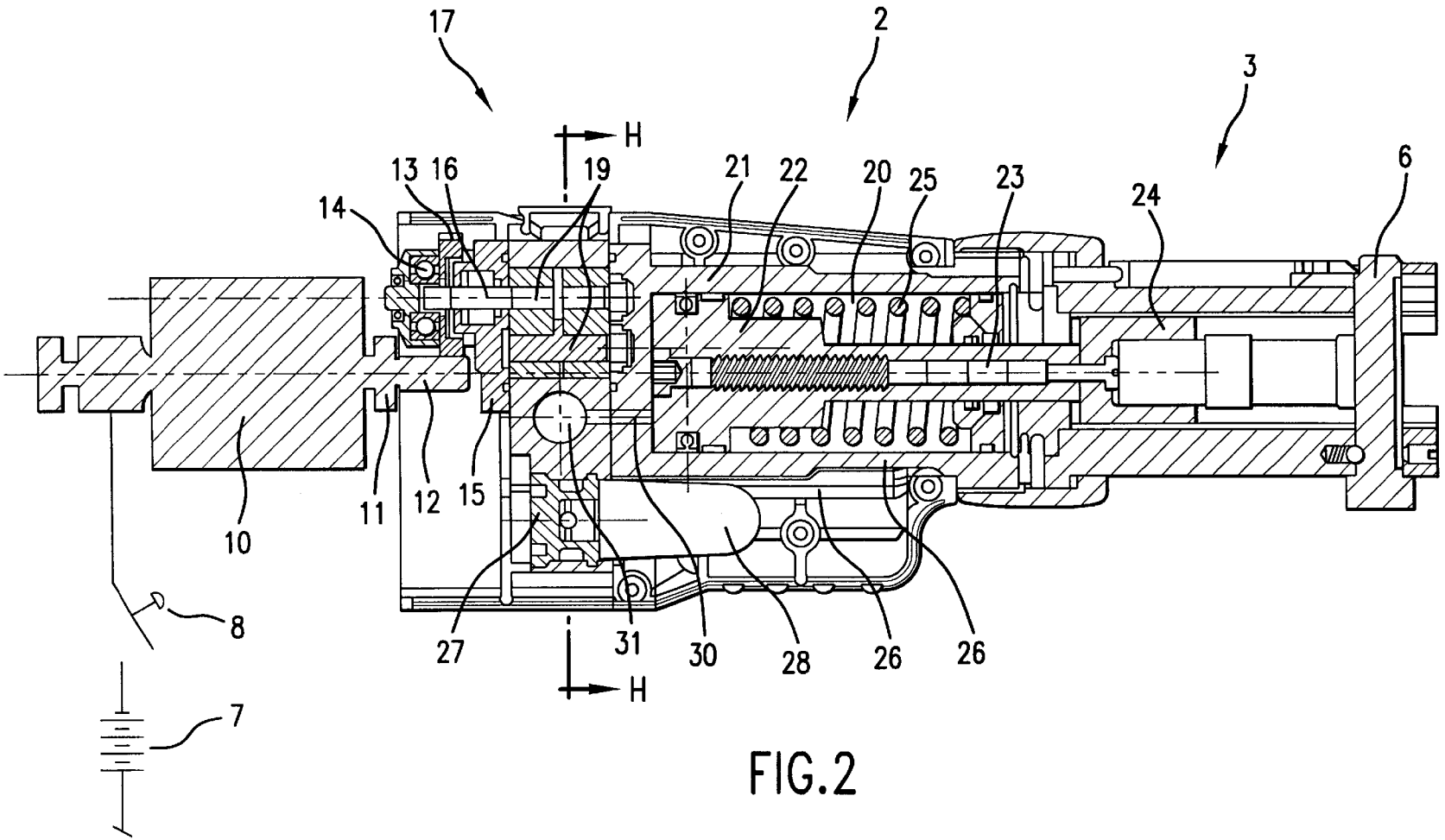
FIG. 2 is a vertical longitudinal section view of a function unit of the pressing tool.

The actual construction of the pressing tool function unit 2 is shown in FIG. 2. The drive is performed by an electric motor 10 which is supplied by the battery feed 7. The release switch 8 is arranged between the electric motor 10 and the battery 7. The electric motor 10 has an output shaft 11 with an end-side output pinion 12 that meshes with a gearwheel 13 which is mounted on a gear output shaft 16. The gear output shaft 16 is mounted in a gear bearing 14 and in a gear housing 15 which is sealingly passed through by the gear output shaft 16. A continuation of the gear output shaft 16 forms one of the two rotor shafts 19 of a gear pump 18 (see FIG. 3).

The lower rotor shaft 19 is mounted in the gear housing 15. The counter bearing of both rotor shafts 19 are in the cylinder housing 21 of the piston cylinder unit 20 held in suitable sliding bearings.

The hydraulic block 17 is completely passed through by the two rotors or rotor shafts 19 of the gear pump 18. In the same hydraulic block 17 right at the bottom there is mounted an outlet peg 27 which communicatingly is connected to a reservoir 28 variable in volume and via suitable lead bores in the hydraulic block 17, via a valve unit 31, is connected to the gear pump 18. In the hydraulic block 17 there is a lead line 29 and a pressure line 30, acting as bores, via which the outlet peg 27 is in communicating connection with the gear pump 18 and the gear pump 18 with the piston cylinder unit 20. The hydraulic block 17 has a piston space return travel 26 via which hydraulic oil displaced during the load stroke via the outlet peg 27 may be led back to the reservoir 28 which is changeable in volume or with the return travel of the piston accordingly hydraulic oil may be led back into the piston space.

With the arrangement according to this invention and the use of the gear pump 18, a particularly simple design solution is achieved and with the relatively large gear pump a large delivery output may be achieved which accordingly has a short operational duration per stroke. The arrangement according to this invention and the use of a gear pump provides simple and short delivery paths for hydraulic oil. Thus sealing problems are minimized and the conduits are manufactured as bores with a relatively large cross section. Thus, flow losses are minimized.

The piston cylinder unit 20 with the cylinder housing 21, with the exception of the integrated sliding bearing for the rotor shafts of the gear pump 18, is configured conventionally. In the cylinder housing 21 there is mounted the piston 20 on which there acts a restoring spring 25. The piston 22 via the piston rod 23 displaces a roller bearing 24 for actuating the clamping pincer 4.

A further advantage of the solution according to this invention is that there is not a multitude of valves which could lead to considerable flow losses, but rather a single valve unit 31 is sufficient. This valve unit permits large flow rates in the lead direction, by which the mentioned losses are kept very low.

Figure 4:
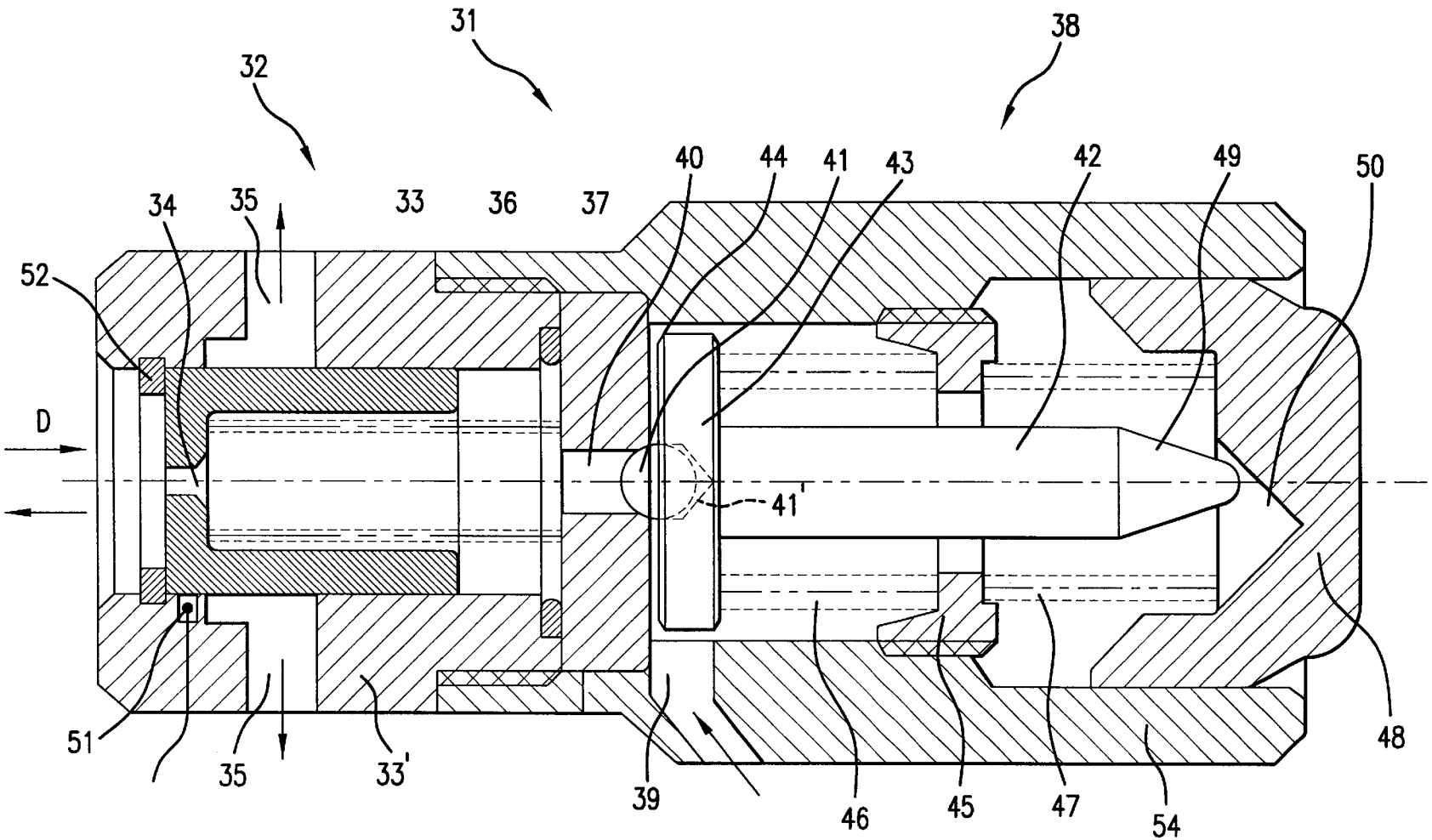
FIG. 4 is a simplified longitudinal section taken through a valve unit, which is shown separately.

With regard to the construction of the valve unit 31, FIG. 4 shows the construction in a simplified manner. The valve unit 31 has two housing parts which are screwable to one another, wherein the one housing part accommodates the first lead change-over valve 32, and the second, larger housing part accommodates a ball valve 38 as a second valve. The first valve 32 is separated from the second valve 38 by a valve plate 37. In the housing of the first, lead change-over valve 32 there is an axially displaceable mounted hollow piston 33. The displacement of the hollow piston 33 is at the inlet side limited by a securing ring 52 and limited on the other side by the valve plate 37. The hollow piston 33 is at the side directed towards the valve plate 37 completely open, while in the closed end on the side of the piston head there is arranged a relatively small relieving bore 34. The housing part 33' forms the cylinder of the valve in which the hollow piston 33 is axially movably mounted. Into the hollow piston 33 there engages a restoring spring 36 which rests on the inside on the piston head and is supported on the valve plate 37. The prevailing oil pressure D displaces the hollow piston 33 against the force of the restoring spring 36 until the hollow piston 33 opens the lateral lead bores 35 to the pressure line. Via the pressure line 30 the hydraulic oil enters the piston cylinder unit 20 and displaces the piston 22 which with the piston rod 23 displaces the roller bearing 24 and thus leads to the actuation of the clamping pincer 4.

The second valve 38 supports the case of a ball valve which via the return travel bore 39 is in communicating connection with the pressure conduit and via the passage bore 40 through the valve plate 37 in connection with the cylinder 33' of the first valve 32. This connection, by way of the valve ball 41, is closed or opened depending on the pressure. The second valve 38 has a valve body 42 with a valve body foot 43. The valve body foot 43 has the shape of a circular disk which is connected as one piece to the valve body 42 and in which centrally there is a ball receiver 53 in which the valve ball 41 is partly mounted. The valve plate 37 forms the valve seat for the valve ball 41. In the housing 54 of the second valve 38 there is screwed-in a spring counter bearing 45 in the form of a ring. Between the spring counter bearing 45 and the valve body foot 43 there is arranged a compression spring 46. The characteristics of the compression spring 46 determines the change-over pressure. If the change-over pressure is reached the valve ball 41 is lifted, onto the hollow piston and there arises a counter pressure and the hollow piston 33 with the help of the restoring spring 36 is displaced back to the securing ring 52, wherein the lead openings 35 are closed. This is independent of whether or not the gear pump 18 continues to deliver.

If for reasons which are not explained a blocking or an incomplete stroke release occurs, then via manual actuation of a push button 48 the pressure may be built up. The push button 48 can be a restoring spring 47 held in the original position. With pressure on the push button 48 a rounded head 49 of the valve body 42 moves in an eccentric bore which is indicated as a tilt surface 50. The head 49 is simultaneously pivoted to the side, wherein the whole valve body 42 takes part in this pivot movement. Thus the valve body foot 43 with a tilting edge 44 bears on the valve plate 37 on one side and pivots about the point of bearing. As a result the valve body foot 43 in the middle lifts slightly and the valve ball 41 is relieved of pressure. The pressure may now be relieved through the passage bore 40 in the valve plate 37 and the first valve 32 again closes.

On closing the first valve 32 the hollow piston 33 travels back in a jolted manner. For the user the knocking of the valve may be heard. As soon as the user hears the closing of the valve the user releases the release switch 8. It is possible in the cylinder 33' of the first valve 32 in the lower region to arrange a sensor 51 which acts on the release switch 8, or interrupts the feed conduit from the battery 7 to the electric motor 10. This sensor is activated, time-delayed so that it is activated when the hollow piston 33 is in the open condition and thus only then realizes the closure procedure. By way of such a sensor 51 it may be ensured that the user does not unnecessarily load the energy source after the completion of a stroke movement.

The embodiment shown has a battery-operated apparatus. The enormous advantages, specifically the short operational period per working stoke, the extremely economical manufacturability and the weight saving which can be achieved by way of the compact arrangement are desirable with mains electricity pressing tools. This invention relates to mains electricity pressing tools.

What is claimed is:

1. In a portable, hydraulically functioning pressing tool (0) for pressing coupling elements with a fork-like receiver (3) and with a clamping pincer (4) held in the receiver (3) and activated by a piston cylinder unit (20) with an integrated restoring spring (25), wherein a pressure bearing on the piston cylinder unit (20) is produced by a hydraulic pump (18) driven by an electric motor (10), and wherein the hydraulic pump (18) is arranged in a hydraulic block arranged between a drive-side gear (13) and the piston cylinder unit (20), the improvement comprising:

the hydraulic pump (18) being a gear pump with rotor shafts (19) mounted on one side in a bearing housing (15) of a gear output shaft (16) and on an other side in a housing (21) of the piston cylinder unit (20), and a plurality of hydraulic pressure conduits formed as bores in a hydraulic block (17) in which the rotor shafts (19) of the gear pump (18) and a valve unit (31) are arranged.

2. In a pressing tool according to claim 1, wherein the hydraulic block (17) has a bore in which an outlet peg (27) is fastened which holds a reservoir (28) with a variable volume.

3. In a pressing tool according to claim 2, wherein the valve unit (31) in the hydraulic block (17) is arranged between the gear pump and the outlet peg (27).

4. In a pressing tool according to claim 2, wherein the reservoir (28) is a rubber bellows.

5. In a pressing tool according to claim 1, wherein the valve unit (31) comprises two valves (32,38) connected behind one another, wherein a lead-side first valve (32) of the valves (32, 38) comprises a spring-loaded (36) hollow piston (33) as a valve body which is pressure-dependently displaceable in a cylinder (33'), and the second valve (38) of the valves (32, 38) is a ball valve wherein a ball (41) bears on a passage bore (40) through a valve plate (37) between the first valve (32) and the second valve (37) in a spring-pressure-loaded manner so that the hollow piston (33) opens and closes openings (35) of a pressure line and the second valve (38) opens and closes a return travel (39) through the valve plate (37).

6. In a pressing tool according to claim 5, wherein the second valve (38) comprises a valve body (42) with a foot (43) with a tilt edge (44), wherein the valve ball (41) is mounted in a receiver (41') in the foot (43), and over a head (49) of the valve body (42) is arranged a manually displaceable push button (48) with which the head (49) of the valve body (42) is displaceable to a side so that the valve body (42) pivots from an axial direction and via the tilt edge (44) of the foot (43) exerts a pivot movement by which the second valve (38) opens.

7. In a pressing tool according to claim 6, wherein the push button comprises an eccentric tilt surface (50) onto which the head (49) bears on and actuates the push button (48) and is displaceable from a center to the side in a tilting movement.

8. In a pressing tool according to claim 5, wherein the electric motor (10) is fed by a battery (6) arranged in the pressing tool (0).

9. In a pressing tool according to claim 8, wherein a restoring movement of the hollow piston (33) is monitored by a sensor (51) and switches off the battery-fed electric motor (10).

* * * * *